United States Patent [19]

Morris et al.

[11] 4,442,374

[45] Apr. 10, 1984

[54] DUAL LENGTH COPIER LAMP

[75] Inventors: Merle E. Morris; Lawrence M. Rice, both of Lexington; Steven L. Meade, Winchester, all of Ky.

[73] Assignee: GTE Products Corporation, Stamford, Conn.

[21] Appl. No.: 362,016

[22] Filed: Mar. 25, 1982

[51] Int. Cl.[3] ..... H01K 9/00; H01K 1/18

[52] U.S. Cl. ..... 313/316; 313/1; 313/274; 315/67; 315/68

[58] Field of Search ..... 313/316, 274, 315, 1; 315/67, 68, 98, 64

[56] References Cited

U.S. PATENT DOCUMENTS

| | | | |
|---|---|---|---|
| 3,039,015 | 6/1962 | Jolly | 313/279 |
| 3,211,943 | 10/1965 | Cardwell, Jr. | 313/315 |
| 3,219,872 | 11/1965 | Hodge | 313/316 |
| 3,225,247 | 12/1965 | Audesse et al. | 313/271 |
| 3,295,007 | 12/1966 | Young | 313/273 |
| 3,335,312 | 8/1967 | Cardwell, Jr. | 313/279 |
| 3,443,144 | 5/1969 | Freese, Jr. | 313/316 |
| 3,634,722 | 1/1972 | Palmer | 313/279 |
| 3,678,319 | 7/1972 | Notelteirs et al. | 313/271 |
| 3,736,455 | 5/1973 | Notelteirs et al. | 313/274 |
| 4,070,594 | 1/1978 | Fuchi et al. | 313/1 |
| 4,080,548 | 3/1978 | Johnson | 315/68 |
| 4,285,032 | 8/1981 | Honda et al. | 362/224 |
| 4,329,622 | 5/1982 | Corona et al. | 315/67 |

*Primary Examiner*—Saxfield Chatmon
*Attorney, Agent, or Firm*—Lawrence R. Fraley

[57] ABSTRACT

A tubular incandescent lamp for use in a fusing type lamp in a photocopy machine in which the lamp filament means is capable of operation at two different lengths on a selective basis as a function of the different lengths of paper that are to be reproduced by the copier. In one embodiment the filament means comprises a single linear filament with the contacts being taken at opposite ends of the filament for full length reproduction and along a predetermined length of the filament or shorter length of reproduction. In an alternate embodiment of the invention, two different length filaments are employed, each one selectively and mutually exclusively operated.

18 Claims, 5 Drawing Figures

SWITCH
CONTROL
POWER SUPPLY
V1
V2
a
b
c
d

POWER SUPPLY
CONTROL
SWITCH

DUAL LENGTH COPIER LAMP

TECHNICAL FIELD

The present invention relates in general to tubular incandescent lamps, and pertains, more particularly, to such lamps as applied in photoreproduction processes.

A photocopy machine typically employs two different types of lamps, one being referred to as an exposure lamp and the other as a fusing lamp. The exposure lamp is purely for light emitting purposes during the exposure phase of operation. The fusing lamp on the other hand is primarily for heating purposes to "set" the toner employed in the photocopy machine. In accordance with the present invention, the principles thereof are applied primarily in connection with a fusing lamp.

BACKGROUND

Fusing lamps as presently employed are typically of single filament construction and have a length corresponding to the maximum size (length) of paper that is to be reproduced. This means that for normal size paper, that is in distinction to, for example, legal size paper, more than necessary energy is expended to perform the process of setting the toner. This excess expended energy is costly and creates unnecessary heating in the photocopy machine. The excess energy is expended by virtue of the energization of the entire length of the filament even though portions of the filament do not have a corresponding paper area in which the toner is being set.

DISCLOSURE OF THE INVENTION

One important object of the invention is to provide a tubular incandescent lamp or preferably a fusing lamp for photocopier applications having a filament means that may be selectively operated to provide two different filament lengths with the aforesaid selection being made on the basis of one of two different lengths of paper used in the photocopy machine. With this filament selection technique, there is an energy saving by expending only the watts necessary to set the toner. There is thus realized a cost saving and furthermore, less overall heat is dissipated in the photocopy machine.

To accomplish the foregoing and other objects of this invention there is provided a tubular incandescent lamp which comprises a tubular quartz envelope and filament means disposed in the envelope and extending substantially the length thereof along a maximum filament distance. First contact means are provided at one end of the filament means. Second and third selective contact means are disposed at the other end of the filament means, with each associated with a different filament length of the filament means, one length being said aforementioned maximum filament distance and the other length being less than said distance. Press seal means are provided for closing the envelope. In the preferred embodiment of the present invention the filament means comprises a single filament with the second contact means taken at the end thereof opposite to the first contact means end, and the third contact means taken at a predetermined point along the linear filament intermediate the ends thereof. In accordance with another embodiment of the present invention described hereinafter, the filament means comprises two separate filaments disposed in parallel within the same or separate envelopes, one having a length greater than the other. These different lengths, of course, correspond to the different lengths of paper used in the photocopy machine.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
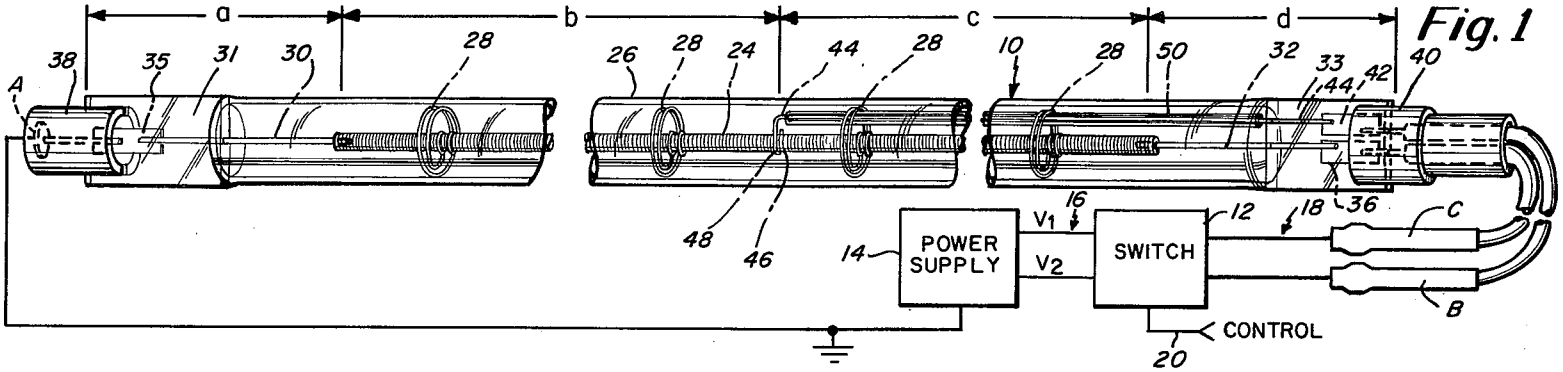
FIG. 1 is a perspective view of a dual length, copier fusing lamp constructed in accordance with a preferred embodiment of this invention and furthermore illustrating the electrical switching control associated with the lamp.

With particular reference to FIG. 1, there is shown a tubular incandescent infrared fusing lamp 10 adapted for use in a photocopying machine in which it is desired to provide controlled heating for the purpose of setting the toner in the photocopy machine whereby in one mode of operation the fusing lamp is operated at one filament length and in another mode of operation the lamp is operated at a shorter filament length. These different filament lengths correspond to two different lengths of paper usually used in the photocopying machine. Thus, in FIG. 1, in conjunction with the lamp 10 there is shown associated control means including switch 12 and power source 14. The tubular incandescent lamp 10 is shown having three contact terminals A, B, and C. The contact terminal A may be termed a common contact coupling to the common terminal of the power source 14 shown in FIG. 1 as being grounded. The contact terminals B and C have appropriate voltages applied thereto from the power source 14 by way of the control switch 12. The power source 14 and switch 12 may be of conventional design and are provided external of the lamp in the photocopy machine itself. A first pair of lines 16 couple from the power source 14 to the switch 12 and a second pair of lines 18 couple from the switch 12 to the contact terminals B and C. The switch 12 is also shown as having an input control terminal 20. The switch 12 is preferably an electronic type switch including one or more transistors and the output signals on the lines 16 may be at two different AC voltage levels such as at, for example, 84 VAC and 120 VAC. The input signal at the input line 20 to the switch 12 may be a bi-state signal in which the lower voltage signal from the power source 14 is coupled to contact terminal B, while in the other state of the signal on line 20, the higher voltage signal is coupled by way of the switch 12 to the terminal C. This control is performed in a selective and mutually exclusive manner under photocopy machine control.

The signal applied at contact terminal B, which is the low voltage signal, is used to excite a length of filament for heating and setting toner and reproducing "normal" copy typically on the order of 11 inches in length. Alternatively, for reproduction of legal size paper which is approximately 4 inches longer, a signal is coupled to the lamp at contact terminal C from the switch 12 at full voltage.

FIG. 1 illustrates one form of the tubular incandescent lamp in which the different lengths of filament excitation are accomplished by means of a single linear filament 24 which extends longitudinally the length of the tubular quartz envelope 26. The filament 24 is preferably a coiled tungsten filament. The filament 24 is supported by a plurality of spaced tungsten wire spacers 28. At the opposite ends of the filament there are provided tungsten rods 30 and 32 which engage in the ends of the coiled filament and which are supported in respective end press seals 31 and 33 of the envelope 26. The tungsten support rods 30 and 32 couple within the press seal to molybdenum foil sections 35 and 36, respectively. The foil section 35 couples to contact terminal A within ceramic mount 38. Similarly, the foil section 36 is held by a ceramic mount 40 and coupled to the contact terminal C.

FIG. 1 also shows the contact terminal B which connects to the ceramic mount 40. In addition to the molybdenum foil section 36, the mount 40 also supports the molybdenum foil section 42 which carries a tungsten rod segment 44 which extends in parallel to the tungsten support rod 32. The rod 44 extends to the filament at area 46 wherein a loop 48 is formed in the rod 44 for looping about and making firm contact with the elongated linear filament at the area 46. The tungsten rod segment 44 is housed within a small diameter quartz tube 50.

In FIG. 1 dimensions associated with the lamp are illustrated. For example, the dimensions a and d are both 2 1/16 inch. The total length of the coiled tungsten filament is represented by the dimensions b+c which is 15 inches. The dimension c is about 4.5 inches. The dimensions b+c corresponds to paper reproduction at legal size. The dimension b thus represents copy reproduction at normal size (approximately 11 inches).

Thus, when the copier is controlling the switch 12 line 20 for "normal" paper reproduction, a switching voltage of on the order of 84 VAC is coupled from the power source 14 so as to provide this voltage difference between contact terminals A and B. When this occurs, the filament section to the right of area 46 in FIG. 1 is not excited. The rod segment 44 essentially shorts out the by-passed portion of the filament so that only the non-by-passed portion of the filament is activated to in turn cause the desired infrared heating only over the dimension b length.

On the other hand, when the switch 12 is operated in the mutually exclusive opposite mode under a control at input line 20, the opposite line from the power source 14 couples by way of the switch 12 to the contact terminal C. The voltage applied from the power source in this example is for a reproduction of legal size copy in which a larger voltage of, for example, 120 volts AC is applied between contact terminals A and C.

The switching operation controlled by the electronic switch 12, as mentioned previously, causes a switching of the voltage from 120 volts between contact terminals A and C to 84 volts between contact terminals A and B. When this occurs, the total wattage goes from 1600 watts corresponding to a voltage of 120 volts down to 1120 watts corresponding to a voltage of 84 volts. However, although the total wattage decreases, the wattage gradient is substantially maintained at a fixed value which in the example given, is on the order of 106 watts per inch at a coil color temperature of 2400° K.

Figure 2:
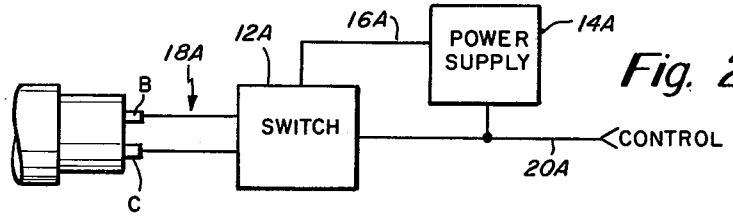
FIG. 2 is a fragmentary view showing an alternate form of switching control for the lamp of FIG. 1.

Referring now to FIG. 2, there is shown an alternate switching arrangement employing a power source 14A coupling by way of line 16A to an electronic switch 12A. The switch 12A has two output lines 18A that couple to the respective contact terminals B and C. The lamp illustrated in FIG. 2 may be identical to the one shown in FIG. 1. There is also provided an input control line 20A which in this embodiment couples to both the power source 14A and the switch 12A. When setting toner for the maximum filament length (legal paper), the control signal on line 20A controls the power source 14A to provide a 120 volt RMS signal by way of the switch 12A and the appropriate line 18A to the contact terminal C. When the control line 20A reverts to its opposite state, then the switch 12A is conditioned to pass the signal on line 16A instead to the contact terminal B. In this case, the control line 20A controls the power source 14A by switching by way of a diode in the power source to provide approximately 84 volts RMS for the shorter excited length of filament. This has the advantage of greatly simplifying the power supply, particularly in an application where very tight tolerances may not be necessary.

Figure 4:
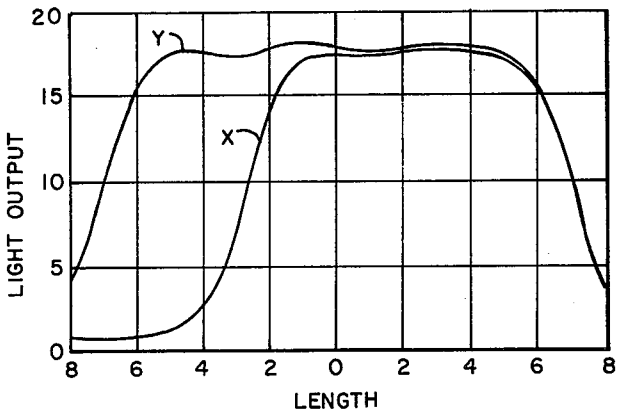
FIG. 4 is a graph of light output versus measurement points along the lamp for both partial filament and complete filament operation.

FIG. 4 is a waveform showing light output versus detection location along the length of the lamp envelope. FIG. 4 shows the light output waveform X for the shorter filament length and the light output waveform Y for the longer filament length. The energy profile illustrated in the graphs is traced using an aperture of 0.300 inch diameter at a distance of 50 millimeters from the filament coil. This clearly illustrates the manner in which the energy is maintained over both the shorter and longer excited filament sections. When applying 84 volts between contacts A and B, 85% of the maximum energy (measured at the center of the lighted section) is maintained over approximately 8½ inch distance. Using the same setup and applying 120 volts between the contact terminals A and C, 85% of the maximum energy was also maintained but over a distance of approximately 13 inches.

Figure 3:
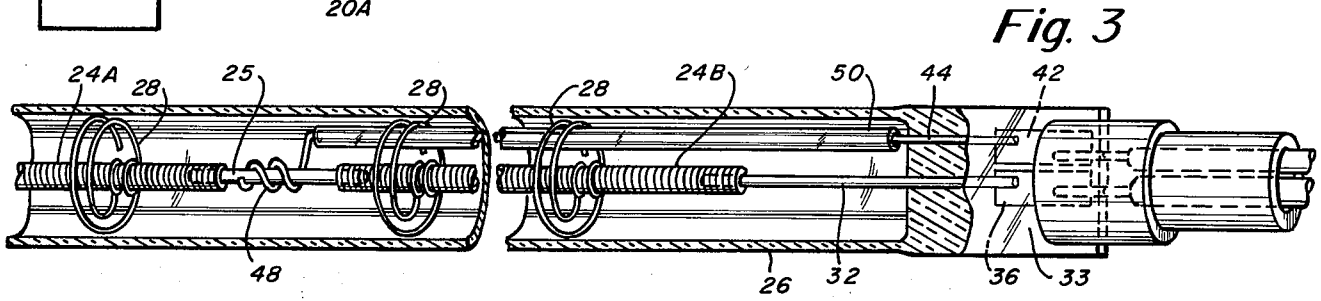
FIG. 3 is a perspective fragmentary view showing an alternate modification of the tubular incandescent lamp of FIG. 1.

FIG. 3 is a fragmentary perspective view showing an alternate version for the incandescent lamp of FIG. 1. In FIG. 3, like reference characters are employed to identify like parts previously illustrated in FIG. 1. Thus, in FIG. 3 there is shown the envelope 26 containing the filament with the press seal 33 for supporting the molybdenum foil sections 36 and 42. FIG. 3 also shows the tungsten support rod 32. In the embodiment of FIG. 3, rather than a single linear filament, there are provided coil filament segments 24A and 24B which are intercoupled by means of the relatively short tungsten insert rod 25. In this example, the rod 44 is a molybdenum rod having its looped end 48 extending about the tungsten insert 25. The use of such an insert enables the use of a molybdenum rod 44 rather than a tungsten rod (as in FIG. 1) because of the lower temperature that occurs with use of the tungsten insert rod 25.

Figure 5:
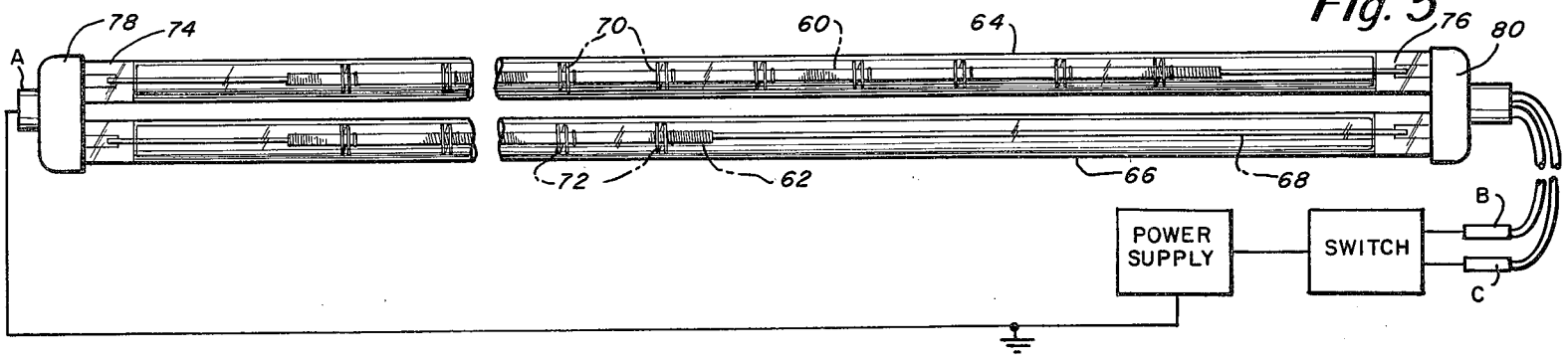
FIG. 5 is another embodiment of the present invention in which two separate filaments of different length are employed.

FIG. 5 illustrates another embodiment of the present invention which employs to filaments 60 and 62 both of which are disposed in parallel within separate tubular quartz envelopes 64 and 66. The filaments 60 and 62 may be supported at their ends by tungsten support rods such as the rod 68 shown in FIG. 5. The filaments are also supported as in the example of FIG. 1 by spacers 70 and 72 associated respectively with the filaments 60 and 62. The envelopes have end press seals 74 and 76 having associated therewith respective end ceramic mounts 78 and 80. The contact terminal A is associated with the mount 78 and the contact terminals B and C are associated with the ceramic mount 80. The contact terminal B couples to the shorter filament 62 while the contact terminal C couples to the longer filament 60. The filament 60 may have a length on the order of about 15 inches while the filament 62 may have a length on the order of about 10.5 inches. The lamp illustrated in FIG. 5 may be used with a switching element such as illustrated in FIG. 1 in which the contact terminal B is adapted to receive a first low voltage signal, or mutually exclusively the terminal C receives a higher voltage signal so as to operate either one or the other of the filaments, depending upon whether the toner is to be set over approximately 11 inches in one case or over approximately 15 inches in the other case. In either event, the wattage gradient is preferably maintained constant so that a proper level of toner setting is accomplished whether for "normal" size reproduction or for larger "legal" size reproduction. In an alternate embodiment the filaments may both be in the same envelope.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an incandescent lamp including a tubular quartz envelope, a coiled tungsten filament substantially centrally disposed within said envelope and extending substantially the length thereof, and first and second contact means located respectively at first and second opposing ends of said coiled tungsten filament and electrically coupled thereto, said coiled tungsten filament being energized over the substantially entire length thereof when a predetermined, first voltage is applied across said first and second contact means, the improvement comprising:

means for de-energizing an end portion of preselected length of said coiled tungsten filament while enabling the remaining length of said filament to be energized, said de-energizing means comprising a third contact means located at said second opposing end of said coiled tungsten filament and spaced from said second contact means, said third contact means electrically coupled to said coiled tungsten filament at a point located an established distance from said second opposing end substantially equal to said preselected length of said coiled tungsten filament being de-energized, said de-energizing of said end portion of said filament and said energizing of said remaining length simultaneously occurring when a predetermined, second voltage is applied across said first and third contact means.

2. The improvement according to claim 1 wherein each of the ends of said tubular quartz envelope includes a press seal, each of said first and second contact means comprising an electrically conductive support rod and associated electrically conductive foil section electrically coupled to said support rod within a respective one of said press seals.

3. The improvement according to claim 2 wherein said support rod is tungsten and said foil section is molybdenum, said support rod extending within said envelope.

4. The improvement according to claim 2 wherein said third contact means comprises a length of electrically conductive rod sealed at one end within a respective one of said press seals and extending within said envelope substantially parallel to said coiled tungsten filament.

5. The improvement according to claim 4 wherein said third contact means further comprises a conductive foil section electrically coupled to said length of said electrically conductive rod within said respective press seal.

6. The improvement according to claim 5 wherein said length of electrically conductive rod is tungsten and said conductive foil coupled thereto is molybdenum.

7. The improvement according to claim 5 wherein said length of said electrically conductive rod is encased in a hollow tube of electrically insulative material.

8. The improvement according to claim 7 wherein said insulative material is quartz.

9. The improvement according to claim 4 wherein said electrically conductive rod is looped about said coiled tungsten filament at said point located said established distance from said second opposing end to provide said electrical coupling thereto.

10. The improvement according to claim 4 further including an electrically conductive insert rod positioned within said coiled tungsten filament in electrical contact therewith, said electrically conductive rod of said third contact means looped about said insert rod at said point located said established distance from said second opposing end to provide said electrical coupling thereto.

11. The improvement according to claim 10 wherein said conductive insert rod is tungsten and said electrically conductive rod of said third contact means is molybdenum.

12. The improvement according to claim 1 wherein said predetermined, first voltage applied across said first and second contact means is greater than said predetermined voltage applied across said first and third contact means to provide a substantially uniform wattage gradient along said filament during application of either of said voltages.

13. The improvement according to claim 1 wherein said lamp is an infrared heating lamp for use in a photocopier.

14. An incandescent lamp comprising:

first and second tubular quartz envelopes of substantially the same length and positioned substantially parallel to each other, each of said envelopes having a first sealed end portion positioned within a first common mount member and a second sealed end portion positioned within a second common mount member;

a first coiled tungsten filament having a first length and substantially centrally disposed within said first tubular quartz envelope;

a second coiled tungsten filament having a second length shorter than said first length and substantially centrally disposed within said second tubular quartz envelope;

first contact means associated with said first common mount member and electrically coupled to a first end of each of said first and second coiled tungsten filaments;

second and third contact means associated with said second common mount member and respectively electrically coupled to a second end of said first and second coiled tungsten filaments whereby said first coiled tungsten filament will be energized when a predetermined, first voltage is applied across said first and third contact means and said second coiled tungsten filament will be energized when a predetermined, second voltage is applied across said first and second contact means.

15. The incandescent lamp according to claim 14 wherein each end of said tubular quartz envelopes includes a press seal, said first, second, and third contact means each comprising an electrically conductive support rod which extends within said envelope in contact with the respective end of said coiled tungsten filament.

16. The incandescent lamp according to claim 15 wherein each of said electrically conductive support rods is tungsten.

17. The incandescent lamp according to claim 14 wherein said predetermined, first voltage applied across said first and third contact means is greater than said predetermined, second voltage applied across said first and second contact means to provide a substantially uniform wattage gradient for said lamp during application of either of said voltages.

18. The incandescent lamp according to claim 14 wherein said lamp is in infrared heating lamp for use in a photocopier.

* * * * *